US011028993B2

(12) United States Patent
Orisich et al.

(10) Patent No.: US 11,028,993 B2
(45) Date of Patent: Jun. 8, 2021

(54) MOTOR VEHICLE LIGHTING DEVICE AND METHOD FOR IMPROVED MATRIX BEAM UNIFORMITY GENERATION

(71) Applicant: Valeo North America, Inc., Seymour, IN (US)

(72) Inventors: John Steven Orisich, Columbus, IN (US); Brant James Potter, Columbus, IN (US)

(73) Assignee: Valeo North America, Inc., Troy, MI (US)

( * ) Notice: Subject to any disclaimer, the term of this patent is extended or adjusted under 35 U.S.C. 154(b) by 0 days.

(21) Appl. No.: 16/805,145

(22) Filed: Feb. 28, 2020

(65) Prior Publication Data

US 2020/0200354 A1 Jun. 25, 2020

Related U.S. Application Data

(63) Continuation of application No. 15/263,713, filed on Sep. 13, 2016, now Pat. No. 10,627,069.

(51) Int. Cl.

| | |
|---|---|
| ***F21S 41/63*** | (2018.01) |
| ***F21S 41/24*** | (2018.01) |
| ***F21S 41/25*** | (2018.01) |
| ***F21S 41/20*** | (2018.01) |
| ***F21S 41/657*** | (2018.01) |
| ***F21S 41/663*** | (2018.01) |
| *F21S 41/255* | (2018.01) |

(52) U.S. Cl.

CPC ..... *F21S 41/63* (2018.01); *F21S 41/24* (2018.01); *F21S 41/25* (2018.01); *F21S 41/285* (2018.01); *F21S 41/635* (2018.01); *F21S 41/657* (2018.01); *F21S 41/663* (2018.01); *F21S 41/255* (2018.01)

(58) Field of Classification Search

CPC .... G02B 26/005; G02B 26/0875; G02B 3/14; B60Q 2400/20

USPC ..... 362/459–549

See application file for complete search history.

(56) References Cited

U.S. PATENT DOCUMENTS

| | | | | |
|---|---|---|---|---|
| 6,059,428 | A | 5/2000 | Perlo et al. | |
| 8,408,765 | B2 * | 4/2013 | Kuhlman ..... | B60Q 1/085 362/488 |
| 2004/0240217 | A1 | 12/2004 | Rice | |

(Continued)

FOREIGN PATENT DOCUMENTS

| | | | |
|---|---|---|---|
| CN | 101793377 | A | 8/2010 |
| DE | 102008062639 | A1 | 6/2010 |

(Continued)

*Primary Examiner* — William J Carter

(74) *Attorney, Agent, or Firm* — Valeo North America, Inc.

(57) ABSTRACT

A headlamp of a motor vehicle that uses individual light emitting diodes or LEDs to generate individual light beams, which collectively form a composite beam where some of the individual beams overlap neighboring beams because of manufacturing irregularities and form bright spots within the composite beam, which are not desirable. It is possible to de-focus the irregularities from individual beams to thereby spread out the bright spots, and reduce their intensities with another inventive goal to selectively defocus individual beams and soften the edges that apply glare to surrounding vehicles when individual beams are not adjacent individual beams or individual beams that are active and flank surrounding vehicles to be shut off.

14 Claims, 14 Drawing Sheets

(56) References Cited

U.S. PATENT DOCUMENTS

| | | | | |
|---|---|---|---|---|
| 2006/0146552 | A1 | 7/2006 | Shaffer | |
| 2012/0287657 | A1* | 11/2012 | Kuhlman | F21S 43/255 362/510 |
| 2013/0021810 | A1 | 1/2013 | Funk et al. | |
| 2015/0260364 | A1* | 9/2015 | Kliebisch | B60Q 1/143 362/545 |
| 2016/0084469 | A1* | 3/2016 | Fukui | B60Q 1/28 362/521 |

FOREIGN PATENT DOCUMENTS

| | | | |
|---|---|---|---|
| DE | 102012106409 | A1 | 1/2014 |
| EP | 2587125 | A2 | 5/2013 |
| WO | WO 2014/012773 | A1 | 1/2014 |

* cited by examiner

MOTOR VEHICLE LIGHTING DEVICE AND METHOD FOR IMPROVED MATRIX BEAM UNIFORMITY GENERATION

CROSS-REFERENCE TO RELATED APPLICATIONS

This application is a continuation of U.S. application Ser. No. 15/263,713, filed Sep. 13, 2016, the entire contents of which are incorporated herein by reference.

FIELD OF THE INVENTION

This invention relates to a lighting device and method and, more particularly, to a lighting device and method for generating an improved matrix beam utilizing at least one diffuser or deformable optic device.

DESCRIPTION OF THE RELATED ART

In the field of motor vehicle lighting devices, it is known to use lighting devices including a light source, such as a light-emitting diode (LED), and a light guide through which a light beam emanating from the light source propagates. It is not uncommon that the light source is situated in a housing assembly having a lens or cover through which the light propagates. Sometimes, one or more light guides or reflectors, such as a parabolic reflector, may be used to direct or cause the light to propagate through the lens.

Some vehicles are equipped with adaptive driving beams (ADB) that use an array of overlapping beam sections, also known as pixels, to form a composite beam pattern. The pixels or groups of pixels are turned off to form a dark tunnel which can be placed over or aligned with an oncoming vehicle. It is desirable that any vertical sides of each pixel must have a sufficient vertical gradient to form a precise tunnel, but also be able to superimpose smoothing with adjacent pixels. The uniformity of the beam is difficult to manage for regions where pixels overlap when not turned off because of a requirement of a vertical cut-off from each pixel.

FIG. 1 is an example of a prior art vehicle V having a headlamp assembly H that comprises an array A of solid state light sources, such as light emitting diodes (LEDs). The array A is shown as being within the plane of the paper in FIG. 1, but in operation, the array A is situated in the headlamp assembly H vertically, or nearly so, in order to project light beams forward of the vehicle V. Each image IM in FIGS. 1 and 3 is generated by a respective LED. Each image IM can be termed an illumination pixel because it illuminates objects ahead of the vehicle V in FIG. 1. Each LED, such as the LEDs labeled LA, LB, LC, LD in the first column of the array A, projects an image called a pixel. For example, LED LA projects an image IMA; LED LB projects an image IMB; LED LC projects an image IMC; LED LD projects an image IMD, and so on. The headlamp assembly H may comprise an imaging lens, but is not shown in FIG. 1.

Because of manufacturing and assembly tolerances, the optical axes of the LEDs will not, in general, be parallel with each other, but will run in somewhat random directions. For example, in prior art FIG. 2A, the idealized axis for LED LA is axis AX1. However, the actual optical axis for LED LA after manufacture or assembly can have an upward or downward pitch, as indicated by pitch angles P1 or P2, which cause the actual optical axis to deviate from the idealized axis AX1. This pitch can cause image IMA in FIG. 3, which shows the images created by images IMA, IMB, IME and IMF of the array A, to be shifted upward or downward and thereby to overlap image IMB, creating an overlap region 2 in FIG. 3.

As another example, in FIG. 2B, a plan view of LED LA is shown having the actual optical axis AX2. The LED LA can have a leftward or rightward yaw, as indicated by yaw angles Y1 or Y2, which cause the actual optical axis to deviate from the idealized axis AX1. This yaw can cause image IMA in FIG. 3 to be shifted left or right and thereby to overlap image IME, creating an overlap region 4 in FIG. 3. FIG. 4 illustrates light beams B1 and B2 overlapping in regions OL.

As a third example, an LED can be manufactured on a board (not shown) in a rotated position. In FIG. 5A, LED LG is shown rotated slightly counter-clockwise, thereby creating the overlap region 6 in FIG. 3.

As a fourth example, a phantom LED LP in FIG. 5B can be shifted from the ideal location, which is shown in solid outline as LED LS. It is noted that a pixel can be shifted in the manner depicted in FIG. 5B because of a combination of pitch angle and yaw angle as in FIGS. 2A and 2B. However, FIG. 5B indicates displacement of an LED LS, not a pixel, and this displacement of an LED LS is not a result of pitch or yaw angles FIG. 6 illustrates that, despite the misalignment, all images nevertheless lie within a boundary BB.

These variations in the pixel beam pattern can cause a problem in headlamps and headlamp beam patterns, such as adaptive driving beam (ADB) headlamps, as will be explained by reference to FIGS. 7-9. FIG. 7 shows an array of pixels IM of FIG. 1. However, in FIG. 7, only the columns marked L are illuminated. The central three columns are not illuminated, as indicated by the marking D. This creates a non-illuminated tunnel 8 in FIG. 8, which can be used when the vehicle V in FIG. 8 follows another vehicle V toward which the non-illuminated tunnel 8 is directed to reduce glare reaching the other vehicle V2.

One problem is that in order to create an optimal tunnel area 8, the illuminated pixels IM must have sharp borders. That is, as shown in FIG. 9, the intensity I of light must drop off rapidly between the illuminated pixels and the dark pixels.

Light intensity is an indicator of photon flux, such as number of photons per square inch. A convenient approximation for the relative intensity of the overlap regions, such as region 2 in FIG. 3, is that the overlap region will have approximately twice the intensity of the neighboring non-overlapped region. The reason is that the overlap region 2 is the linear superposition of the photons in two light beams of similar intensity. However, while an overlap region will appear generally more intense than a non-overlapped region, the overlap region will not necessarily appear twice as bright to the human eye because perceived brightness is subjective and is not a linear function of light intensity. Thus, the sharp gradient in intensity can produce undesirable results, namely, the overlap OL in FIG. 4 and the overlap regions 2, 4, and 6 in FIG. 3 can be very bright or the overall field covered by pixels IMA, IMB, IME, and IMF in the example will not be uniformly illuminated because of the overlap regions 2, 4, and 6. Unfortunately, government regulations may prohibit the overly bright overlap regions 2, 4, and 6. Even if they do not, it is generally preferred that the pixels in a headlamp beam exhibit uniform illumination. Therefore, a sharply defined tunnel 8 in FIG. 7 requires a sharp gradient between illuminated pixels and dark pixels.

What is needed, therefore, is a system and process for overcoming one or more of these prior art problems.

SUMMARY OF THE INVENTION

One object of the invention is to provide a system and method that overcomes one or more of the problems mentioned herein.

Another object of the invention is to provide a system and method that generates a sharp edge adjacent an unlit area in a beam pattern.

Still another object of the invention is to provide a system and method that diffuses specific beam patterns to soften the intensity of the light or to soften, for example, a vertical cut-off for pixels not close to the unlit area (such as a dark tunnel area).

Yet another object of the invention is to provide a system and method that diffuses specific beam patterns in order to improve beam pattern uniformity.

Another object of the invention is to provide a system and method for accomplishing beam pattern uniformity using at least one diffuser or deformable optic system, such as a deformable liquid object.

Yet another object of the invention is to improve the uniformity of an ADB or matrix beam while also providing an improved system and method for generating sharp edges between lit and unlit areas of a composite beam pattern.

Still another object of the invention is to provide a lighting solution that allows for a smoother beam pattern for regions in a beam pattern where an unlit area, such as a tunnel area in a beam pattern, is not activated.

In one aspect, one embodiment of the invention comprises a method of generating a headlight for a vehicle, comprising at some times, using Light Emitting Diodes, LEDs, to produce light beams, some of which overlap each other and form bright regions at the overlap, and blurring light beams which overlap, to reduce bright regions; and at other times, shutting off some LEDs to create a dark tunnel and not blurring light beams bordering the tunnel.

In another aspect, another embodiment of the invention comprises a method of generating a headlight for a vehicle, comprising projecting two groups of light beams, separated by a dark space between them, wherein some of the light beams overlap to form bright regions; blurring light beams which overlap, to reduce bright regions, but not blurring light beams adjacent the dark space.

In one aspect, one embodiment of the invention comprises a lighting device for a vehicle comprising at least one light source for generating an image array or matrix of pixel images, wherein some pixel images overlap in at least one overlap area; and at least one diffuser which diffuses light reaching the at least one overlap area to reduce an intensity thereof.

In still another aspect, one embodiment of the invention comprises a lighting device for a vehicle, comprising an array of a plurality of light sources which generates a full-width beam when a first plurality of the plurality of light sources are illuminated, and generates a plurality of partial-width beams separated by at least one dark zone when a second plurality of the plurality of light sources are illuminated; and at least one diffuser which reduces at least one spot of high intensity in at least one of the full-width beam or at least one of the plurality of partial-width beams.

In yet another aspect, one embodiment of the invention comprises a lighting device for a vehicle, comprising a plurality of light sources, each of which generates an individual light beam that collectively form a composite light array; a control system which selectively de-activates at least one of the plurality of light sources to form at least one dark region which is juxtaposed to at least one light region; and a plurality of diffusers operatively related to the plurality of light sources, respectively, the control system energizing at least one of the plurality of diffusers to reduce intensity of light in overlap areas where light beams from a plurality of the lighting devices overlap in the at least one light region.

In another aspect, one embodiment of the invention comprises a lighting device for a vehicle, comprising an array (IMAR) of a plurality of light sources, a plurality of the plurality of light sources producing at least one overlapping light beam in at least one light beam overlap area where light beams overlap, and an array of a plurality of diffusers or deformable optical elements operatively associated with the plurality of light sources, respectively wherein each of the plurality of diffusers being capable of changing a focal length so that when it receives light from at least one of the plurality of light sources to selectively reduce an intensity of light in the at least one light beam overlap area.

This invention, including all embodiments shown and described herein, could be used alone or together and/or in combination with one or more of the following list of features:

The lighting device wherein the lighting device comprises a plurality of light sources.

The lighting device wherein the at least one diffuser comprises at least one diffusing element for each of the plurality of light sources, respectively.

The lighting device wherein the at least one diffuser comprises a deformable optic that changes a focal length in response to an electrical signal.

The lighting device wherein the at least one diffuser comprises an array of diffusing elements and each of the diffusing elements in the array of diffusing elements comprises a lens which changes in curvature in response to an electrical signal.

The lighting device wherein the lighting device comprises a control for controlling output of the at least one light source and also for controlling the at least one diffuser, the control energizing the at least one diffuser to reduce intensity of light in the at least one overlap area and not energizing the at least one diffuser when a non-illuminated predetermined condition is met.

The lighting device wherein the non-illuminated predetermined condition is when a sharp edge defining a transition between an illuminated area and a non-illuminated area in the image array or matrix of pixel images is desired.

The lighting device wherein the lighting device comprises a plurality of light sources, a plurality of diffusers and a control for controlling the plurality of light sources and the plurality of diffusers, the control being adapted to energize a first group of the plurality of light sources while deactivating at least one of the plurality of diffusers to cause the image array or matrix of pixel images to comprise a generally sharp transition edge between an illuminated area and a non-illuminated area, the control also adapted to energize the first group of the plurality of light sources while activating at least one of the plurality of diffusers to cause the image array or matrix of pixel images to comprise a smooth intensity in the at least one overlap area.

The lighting device wherein the control activates a plurality of the plurality of light sources and deactivates a plurality of the plurality of diffusers to generate a plurality of sharp edges and an unlit tunnel in the image array or matrix of pixel images.

The lighting device wherein the lighting device is a headlamp.

The lighting device wherein the at least one light sources is at least one of a light-emitting diode LED, a highly pixellized LED, or a laser diode.

The lighting device further comprising an imaging lens which projects images of light produced by the plurality of light sources and wherein the at least one diffuser is located between the plurality of light sources and the imaging lens.

The lighting device wherein the at least one diffuser comprises an array of diffusing elements, and each of the diffusing elements comprises a lens which changes in curvature in response to an electrical signal.

The lighting device wherein the array of diffusing elements comprises a diffusing element for each of the plurality of light sources.

The lighting device the lighting device further comprising a light guide for directing light from at least one of the plurality of light sources to the at least one diffuser.

The lighting device wherein each of the plurality of diffusers comprises a respective diffusing element associated with at least one space between the plurality of light sources.

The lighting device wherein each of the plurality of diffusers comprises a lens which changes in curvature in response to an electrical signal.

The lighting device wherein each of the plurality of diffusers comprise a liquids lens comprising two liquids of different indices of refraction, the lens changing shape in response to an electrical signal.

The lighting device wherein at least one of the plurality of diffusers diffuses light received from a plurality of the plurality of light sources.

The lighting device the lighting device further comprising a light guide for the plurality of light sources, the light guide extending from at least one of the plurality of light sources toward at least one of the plurality of diffusers.

The lighting device wherein the plurality of light sources are at least one of a light-emitting diode LED, a highly pixellized LED, or a laser diode.

The lighting device wherein the plurality of diffusers comprises a respective diffusing element for each of the plurality of light sources.

The lighting device wherein each of the plurality of diffusers comprises a lens which changes in curvature in response to an electrical signal.

The lighting device wherein each of the plurality of diffusers comprises a liquid lens comprising two liquids of different indices of refraction, which change shape in response to an electrical signal.

The lighting device wherein at least one of the plurality of diffusers comprises a respective diffusing element for each of the plurality of light sources.

The lighting device wherein at least one of the plurality of diffusers diffuse light received from a plurality of the plurality of light sources.

The lighting device further comprising at least one light guide associated with each of the plurality of light sources, the light guide extending from at least one of the plurality of light sources toward at least one of the plurality of diffusers.

The lighting device wherein the lighting device is a headlamp assembly comprising a housing and a cover lens that cooperate to house both arrays of the plurality of light sources and the plurality of diffusers.

These and other objects and advantages of the invention will be apparent from the following description, the accompanying drawings and the appended claims.

BRIEF DESCRIPTION OF THE ACCOMPANYING DRAWINGS

DETAILED DESCRIPTION OF THE PREFERRED EMBODIMENTS

Referring now to FIGS. 10-24, various embodiments of the invention are shown. A plurality of diffusers 10 (labeled D1, D2, D3, D4 . . . Dn in FIG. 10) between an plurality of light sources 12 (labeled L1, L2, L3, L4 . . . Ln) and a corresponding plurality of pixels or images IM (IM1, IM2, IM3, IM4 . . . IMn) which the plurality of light sources 12 project. It should be understood that the light source 12 may be any suitable light source or a solid state light source, such as a light emitting diode (LED), a laser diode, arc, neon or fiber optics. For ease of illustration, the light source 12 will be descripted as comprising an LED.

Figure 1:
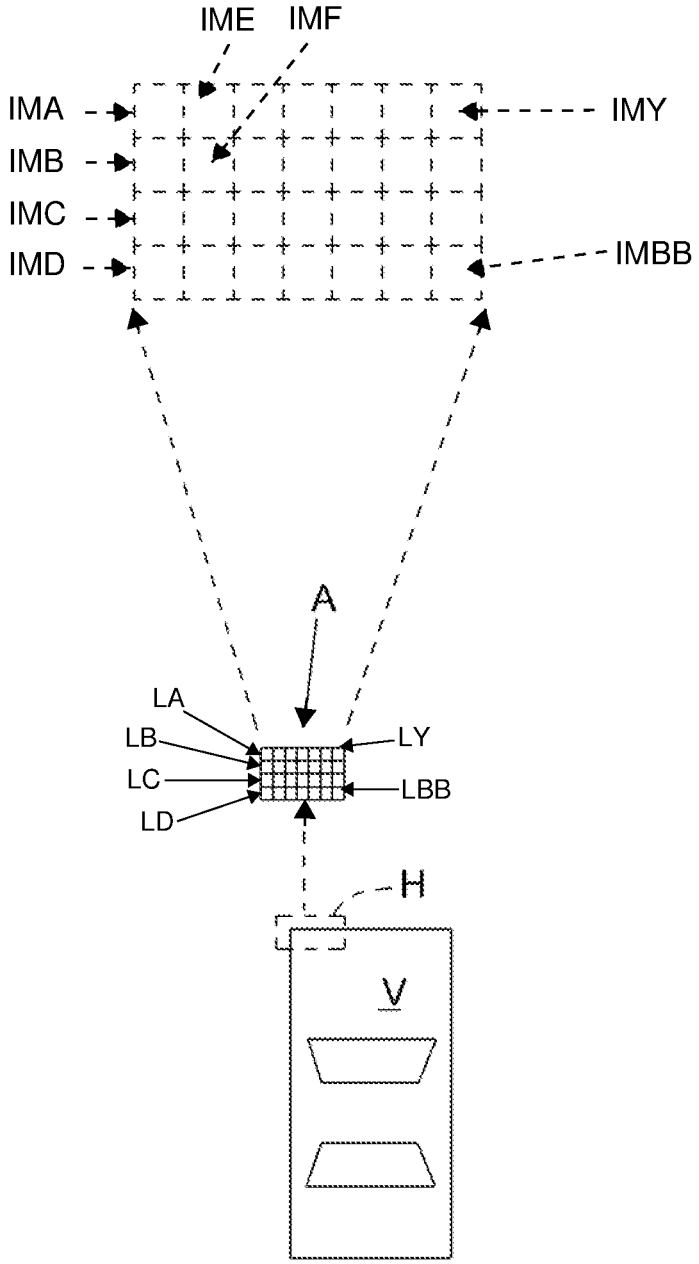
FIG. 1 PRIOR ART
FIG. 1 illustrates a prior art array of light emitting diodes (LEDs) used as a vehicle headlamp.
Figure 2A:
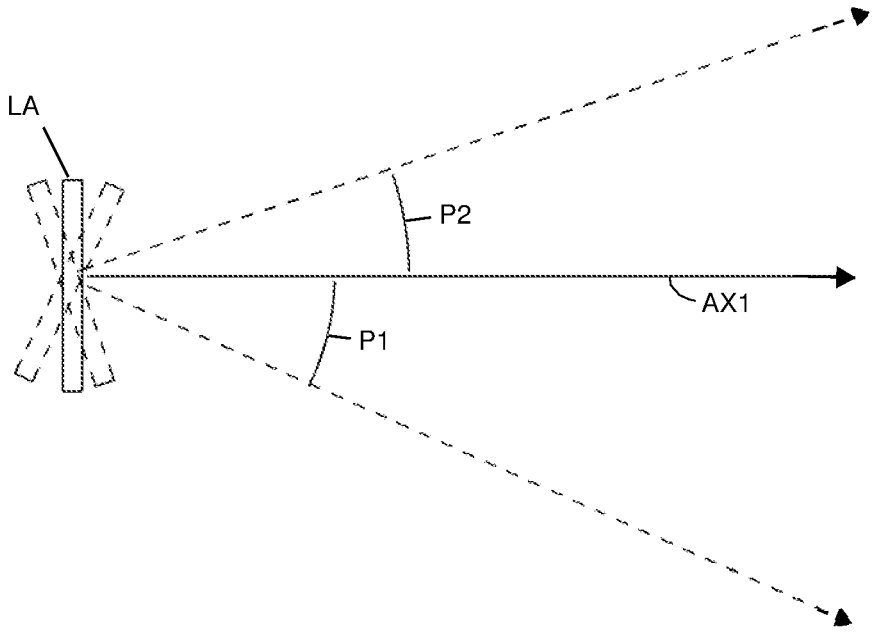
FIG. 2A Prior Art
FIG. 2A (prior art) illustrates how a pitch of the LEDs in the array of FIG. 1 can be misaligned vertically up and down.
Figure 2B:
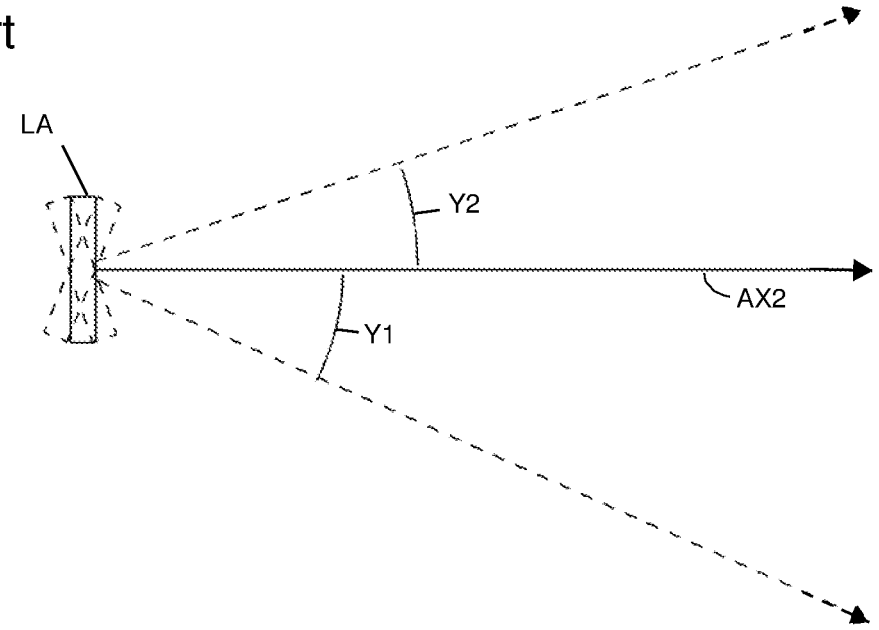
FIG. 2B Prior Art
FIG. 2B (prior art) illustrates how a yaw of the LEDs in the array of FIG. 1 can be misaligned horizontally or yaw.
Figure 3:
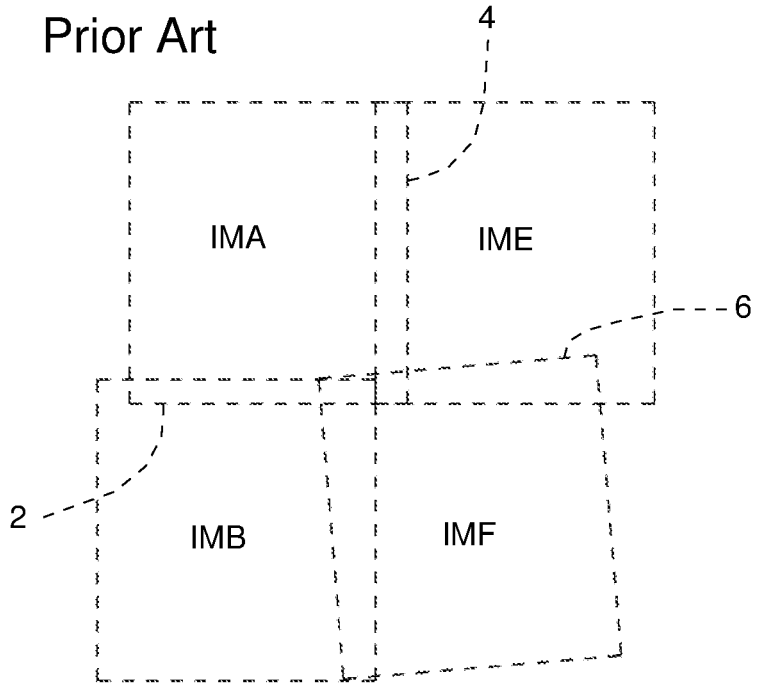
FIG. 3 Prior Art
FIG. 3 (prior art) illustrates how the images in FIG. 1 can overlap as a result of the misalignments indicated in FIGS. 2A, 2B, 5 and 6.
Figure 4:
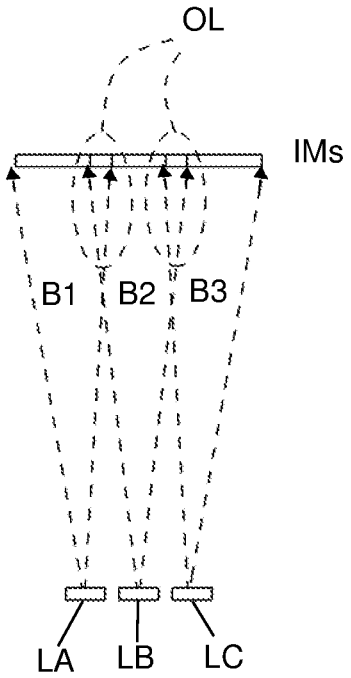
FIG. 4 Prior Art
FIG. 4 (prior art) illustrates overlap regions OL.
Figure 5A:
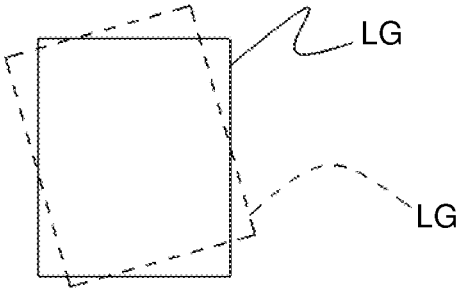
FIG. 5A Prior Art
FIG. 5A (prior art) illustrates how LEDs in the array of FIG. 1 can be misaligned by rotation.
Figure 5B:
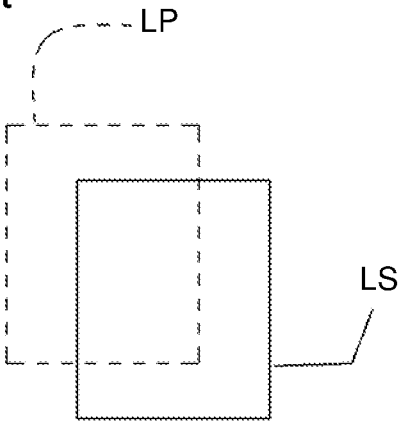
FIG. 5B Prior Art
FIG. 5B (prior art) illustrates how LEDs in the array of FIG. 1 can be misaligned by lateral displacement, vertical displacement, or both.
Figure 6:
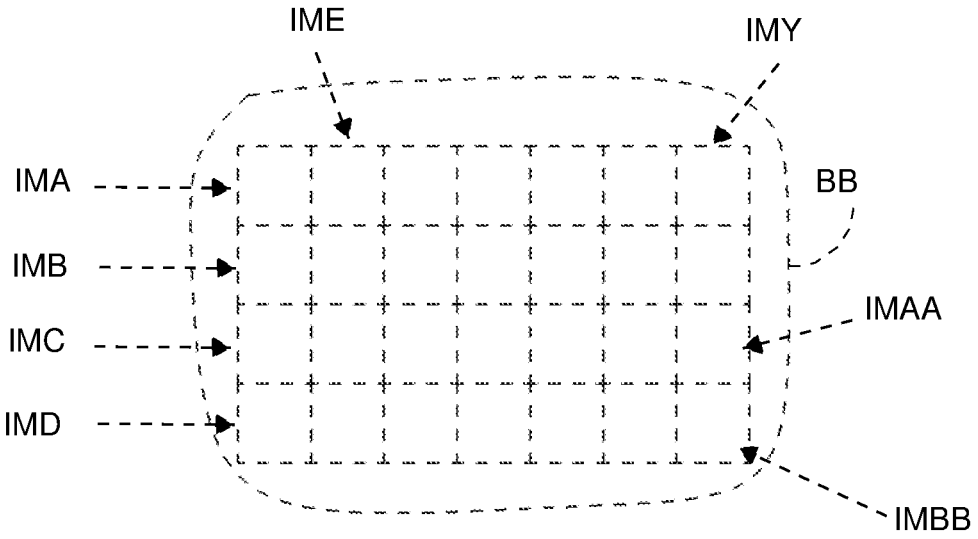
FIG. 6 Prior Art
FIG. 6 (prior art) illustrates that, despite the misalignment, all images nevertheless lie within a boundary BB.
Figure 7:
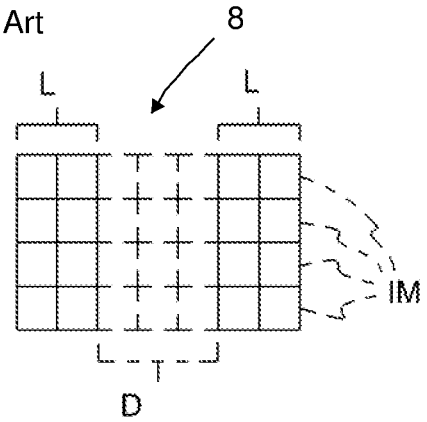
FIG. 7 Prior Art
FIG. 7 (prior art) illustrates which of the LEDs in FIG. 8 go dark in order to generate the tunnel of FIG. 8.
Figure 10:
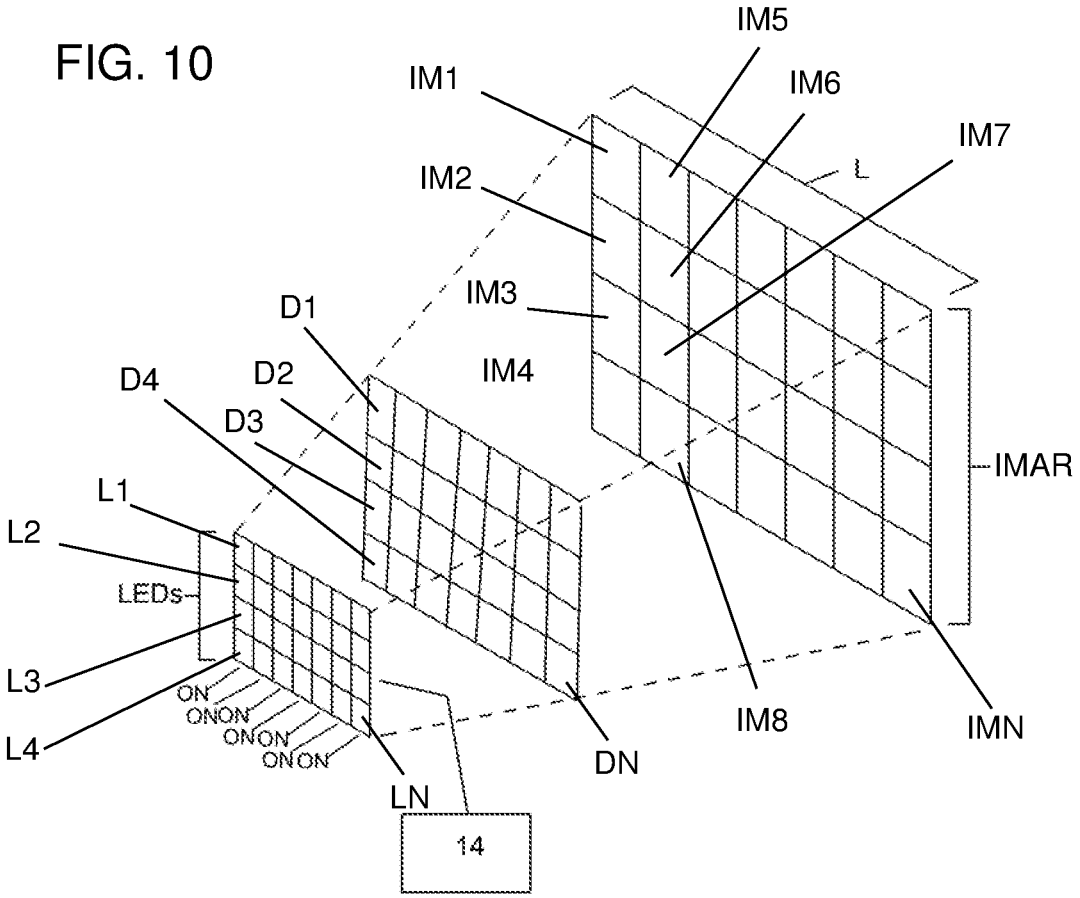
FIG. 10 illustrates one embodiment of the invention with an a plurality of LEDs and a complementary corresponding optical diffusers.

An imaging lens (not shown in FIG. 10) may be present downstream of the plurality of diffusers 10. The plurality of diffusers 10 receive light images from the plurality of LEDs 12 and project those images as the array IMA of a plurality of pixels or images IM1 . . . IMn. FIG. 10 illustrates the plurality of LEDs 12 which transmit light through a corresponding plurality of diffusers 10, respectively, to form the array IMA comprising the plurality of images or pixels IM1 . . . IMn for illuminating the roadway ahead of a vehicle V (FIG. 1). In the example in FIG. 10, the plurality of diffusers 10 are energized and active at this time and diffuse light at the boundaries between adjacent images or the overlap areas. A controller or control 14 is coupled to the plurality of LEDs 12 and the plurality of diffusers 10 and controls their operation. For example, the controller or control 14 determines which of the plurality of LEDs 12 are lit and which are dark. For ease of illustration, the plurality of LEDs 12 and the plurality of diffusers 10 are shown to comprise twenty-eight LEDs 12 and twenty-eight (28) diffusers 10, but they could comprise more or fewer of these components if desired.

Figure 11:
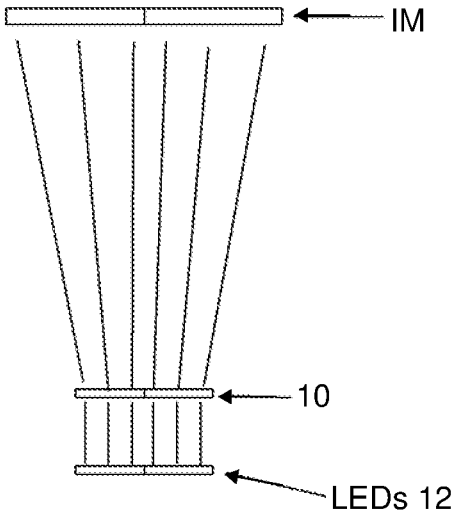
FIG. 11 illustrates the scattering or diffraction of light by the diffusers, which diffuse light between adjacent images.

The controller or control 14 causes the plurality of diffusers 10 to alternate between two states. In one state, they diffuse, disperse, blur, or diffract light passing through them, as indicated in FIG. 11. This diffusion spreads out the regions where the light overlaps, such as the overlap regions 2, 4, and 6 and overlap areas OA1 and OA2 described later. For ease of illustration, FIG. 10 shows the image matrix IMA with each pixel image IM1-IMn being exactly alighted, but it should be understood that in practice, they could be juxtaposed and/or adjacent pixel images IM1-IMn that tend to overlap. The embodiments described herein control the intensity of light in the overlap areas, such as the areas OA1 and OA2 in FIGS. 12 and 13, while permitting sharp edges E1 and E2 (FIG. 13), for example, to be created by selectively controlling the operation of the LEDs 12 and diffusers 10. This diffusion also reduces the intensity of those regions, thereby making the pixels IMA in FIGS. 10 and 11 appear uniform in intensity.

Figure 8:
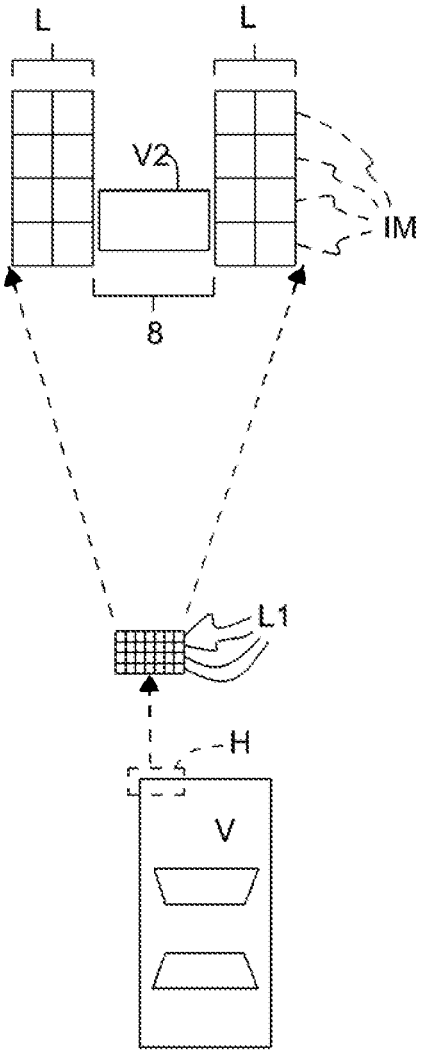
FIG. 8 Prior Art
FIG. 8 (prior art) illustrates a prior art LED headlamp H which generates a tunnel.
Figure 12:
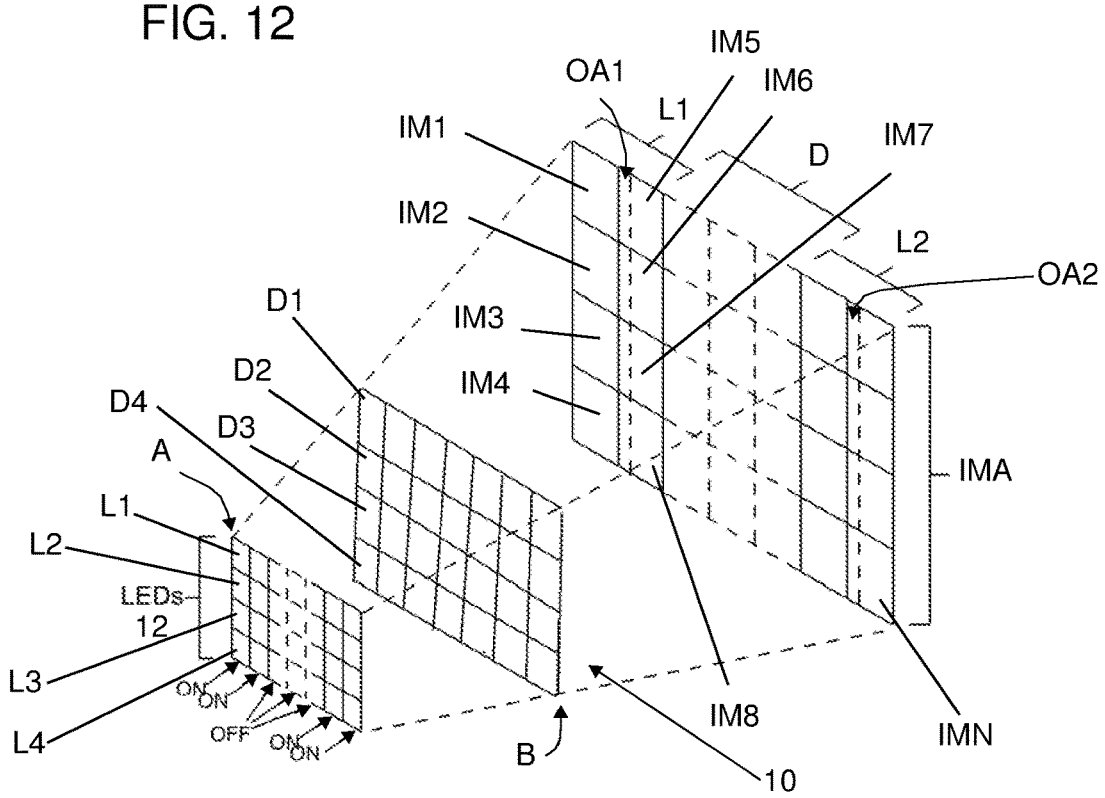
FIG. 12 illustrates one embodiment of the invention showing an array of LEDs which transmit light through a corresponding array of diffusers.
Figure 13:
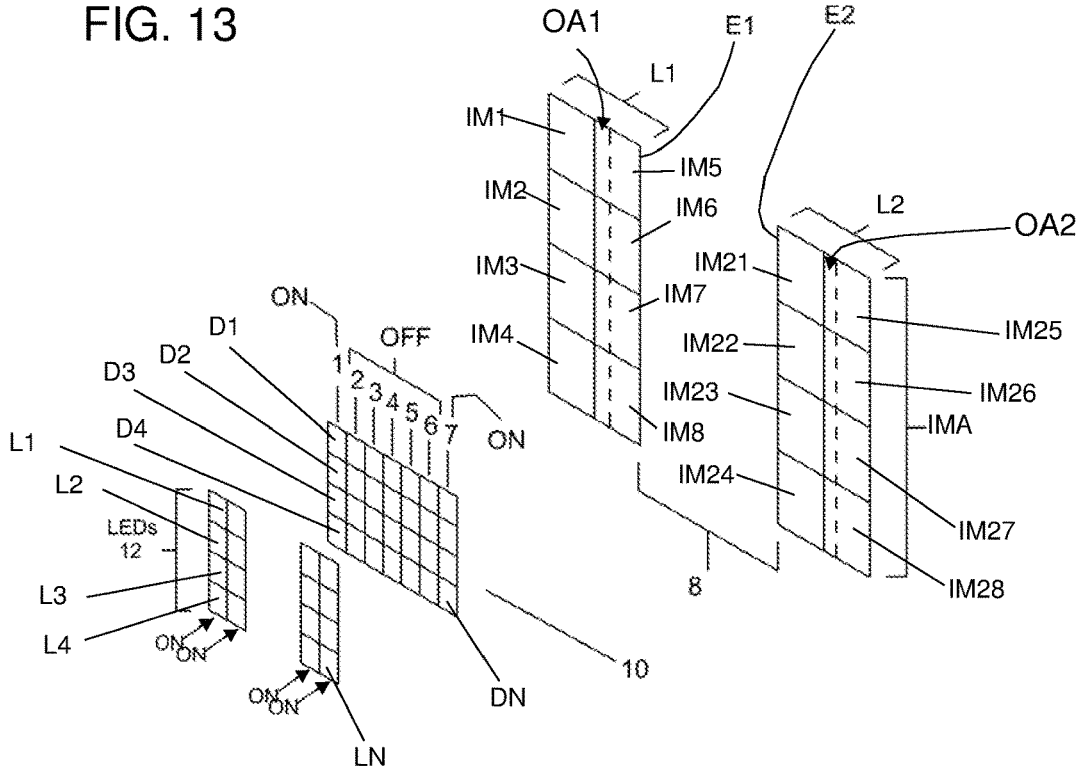
FIG. 13 illustrates three columns of LEDs being shut off, which causes three corresponding columns of pixels to go dark.

The plurality of diffusers 10 can be caused to adopt an off state wherein they are inactive and act as a transparent flat window glass. In this state, the plurality of diffusers 10 do not diffract the light to any significant degree. This state is indicated in FIGS. 12 and 13. In FIG. 12, the central three columns of the array of plurality of LEDs 12 are OFF to create a tunnel D, which is similar to the tunnel 8 in FIG. 8. The tunnel D is also shown in FIG. 13.

In FIG. 13, the plurality of diffusers 10 in columns 2 through 6 are off and inactive, but for two different reasons. The first reason is that the plurality of diffusers 10 in column 2 transmit light to pixels IM5-IM8, but it is desired that the edge E1 (FIG. 13) be sharp so no dispersion of the light is wanted in those pixels in order to maintain the sharpness of edge E1. Hence, the plurality of diffusers 10 in column 2 are off and act as a transparent window glass. A similar comment applies to the plurality of diffusers 10 in column 6, through which light passes en route to pixels IM21-IM24. Those plurality of diffusers 10 are inactive to keep edge E2 sharp.

The second reason is that no light is being transmitted through the plurality of diffusers 10 in columns 3, 4, and 5 (FIG. 13) because the corresponding plurality of LEDs 12 in those columns 3, 4, and 5 are OFF, as indicated in FIG. 12. Consequently, the plurality of diffusers 10 in columns 3, 4, and 5 would have no effect, even if they were activated. Alternately, the diffusers 10 in columns 3, 4, and 5 of the array of diffusers 10 could be left active because they would have no effect because their corresponding LEDs 12 are OFF.

The plurality of diffusers 10 in column 1 (D1-D4) of the diffuser array are active because light en route to images IM1-IM4 passes through those plurality of diffusers 10. That light is diffused to reduce illumination overlap area OA1 where they overlap with images IM5-IM8, respectively. Similarly, the plurality of diffusers 10 in column 7 are active because light en route to images IM25-IM28 passes through those diffusers 10. That light is diffused to reduce illumination overlap area OA2 where they overlap with images IM21-IM24 respectively.

Figure 14A:
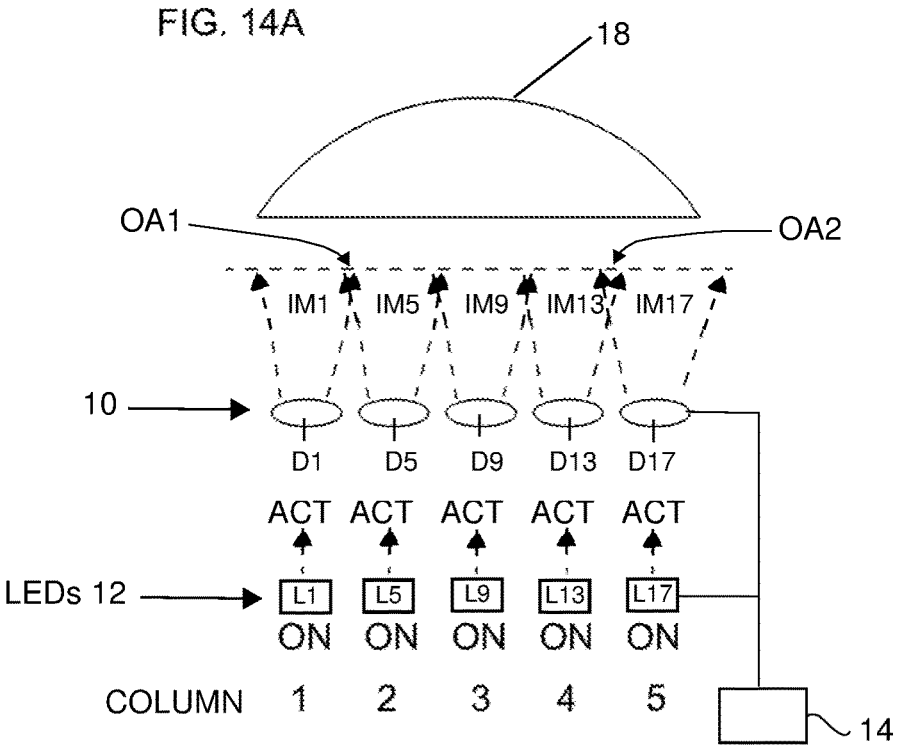
FIG. 14A shows that five columns of diffusers inactive in the embodiment of FIG. 13.

FIG. 14A illustrates a plan view of the embodiment shown in FIG. 10 so that various features of the invention are in a more simplified form for ease of understanding. On the left side, the first or top row LR1 (FIG. 12) of the array of the plurality of LEDs 12 in columns 1 through 5 are all ON, and all of the plurality of diffusers 10 (D1, D5, D9, D13 and D17) in the first or top row DR1 of the diffuser array are active (ACT). As previously mentioned, each of the plurality of LEDs 12 and plurality of diffusers 10 are coupled to and under the control of the controller or control 14, which is configured to selectively energize the plurality of LEDs 12 and plurality of diffusers 10 in response to a desired beam pattern to be generated.

Figure 14B:
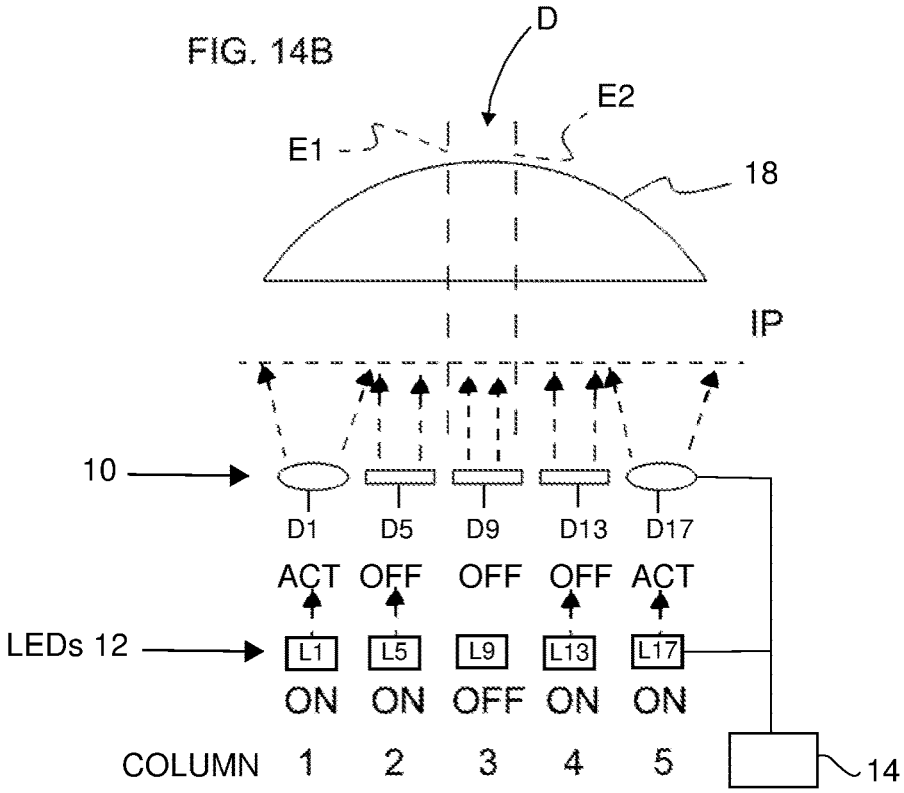
FIG. 14B illustrates how LEDs and diffusers cooperate, to form a tunnel having sharp edges E1 and E2.

In FIG. 14B, the tunnel D is created by turning OFF the LED in column 3. However, the diffusers D5, D9 and D13 in columns 2, 3, and 4 are shut OFF in order to generate a sharp edge for the tunnel D. That is, the left edge E1 of the tunnel D is generated by the drop-off in intensity between the LEDs L5 and L9 in columns 2 and 3. Termination of the diffusers D5 and D9 in those columns 2 and 3 produces the sharp edge E1. Otherwise, if the diffuser D5 in column 2 were to remain active, then the edge E1 defined between the LEDs L5 and L9 in columns 2 and 3 would be diffused or blurred. A similar comment applies to the elements in columns 3 and 4, with respect to the edge E2 of the tunnel D.

Therefore, in one form of the invention, a plurality of LEDs 12 is provided, such as the array A in FIG. 12. A generally matching or corresponding array B of the plurality of diffusers 10 is provided. In one embodiment, there is one diffuser 10 for each LED 12, through which light from each LED 12 travels. It should be understood, however, that there does not have to be a one-to-one correspondence. For example, there could be more diffusers 10 per LED 12. When the plurality of diffusers 10 are active, they diffract or scatter the light to diffuse the light and/or reduce the intensity, especially in overlap areas or regions, such as overlap areas OA1 and OA2 in FIG. 13, which causes a blending of the light in the overlap areas OA1 and OA2 so as to reduce intensity therein.

Thus, it should be understood that one or more LEDs 12 or a group of LEDs 12 can be shut off selectively to generate a dark tunnel, such as tunnel D in FIGS. 12 and 13. Substantially simultaneously, one or more of the diffusers 10 corresponding to those LEDs 12 are shut off. In addition, one or more diffusers 10 are shut off or de-energized which are adjacent the column of inactive LEDs 12, such as the diffusers D5 and D13 in columns 2 and 4, respectively, in FIG. 14B.

Figure 9:
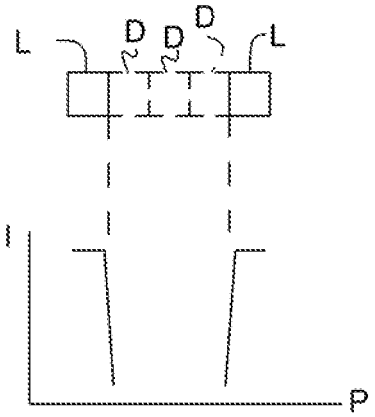
FIG. 9 Prior Art
FIG. 9 (prior art) illustrates the intensity plot of the light in the images of FIGS. 8 and 9, running left-to-right.

It is emphasized that in FIG. 14B, the LEDs L5 and L13 in columns 2 and 4, respectively, define the left edge E1 and right edge E2, respectively, of the tunnel D. These pixels flank the dark tunnel D. These LEDs L5 and L13 exhibit the sharp gradient of FIG. 9, but while those LEDs L5 and L13 are ON, the diffusers 10 (D5 and D13) for those LEDs L5 and L13 are OFF. To repeat, the LED L9 in column 3 is OFF to generate the tunnel 8 and the diffusers D5, D9 and D13 are also OFF. The LEDs L5 and L13 in columns 2 and 4, respectively, are ON, yet their corresponding diffusers D5 and D13 are OFF. The diffusers D5 and D13 which border or flank the tunnel D are kept off to maintain the sharpness of the left edge E1 and the right edge E2, respectively, of the tunnel D. Thus, when the tunnel D is created, there are more diffusers 10 that are turned OFF than LEDs 12 that are turned OFF.

Figure 15:
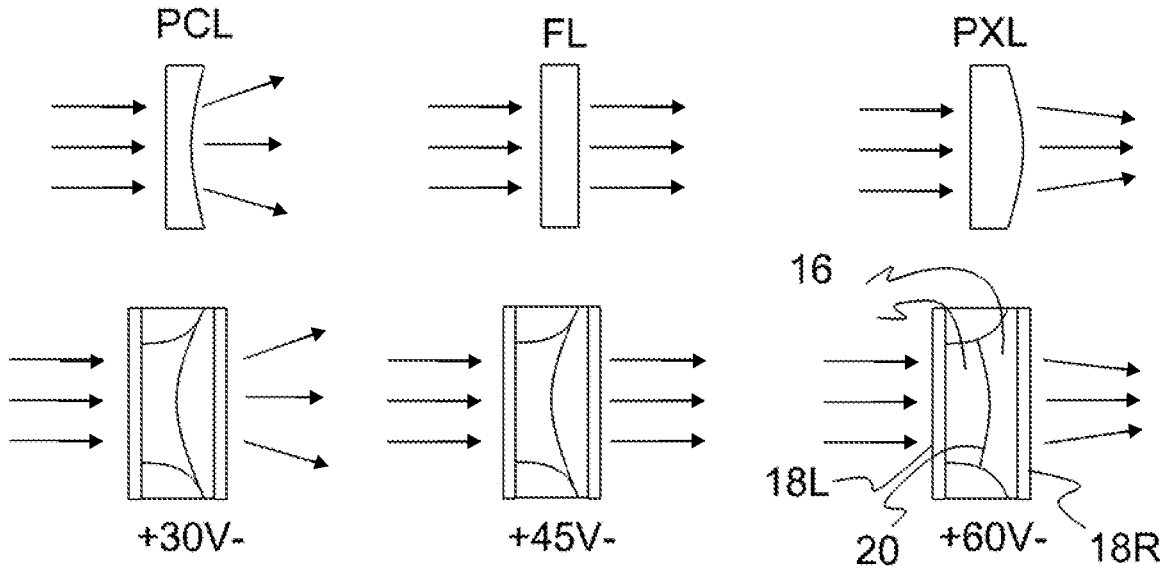
FIG. 15 illustrates one type of diffuser in the form of a deformable optic.

In one embodiment, the plurality of diffusers 10 may comprise a deformable optic constructed as indicated in FIG. 15. Each diffuser 10 contains a chamber filled with a liquid 16 and bounded by flat left and right lenses 18L and 18R made of glass or transparent plastic resin. A flexible element 20 divides the liquid 16 into two parts or chambers. In one form of the invention, the liquid 16 in the two chambers is of two different indices of refraction. For example, one liquid 16 may be water and the other may be oil. Together they form a liquid lens which changes shape under an applied voltage from the controller or control 14. FIG. 15 illustrates a general operation of this embodiment of the diffuser 10. As indicated on the left side of FIG. 15, when the left glass lens 18L is held at 30 volts positive with respect to the right glass lens 18R, the diffuser 10 acts like a plano-concave lens PCL. As indicated in the central region of FIG. 15, when the left glass lens 18L is held at 45 volts positive with respect to the right glass lens 18R, the diffuser 10 acts like a flat lens FL. As indicated on the right side of FIG. 15, when the left glass lens 18L is held at 60 volts positive with respect to the right glass lens 18R, the diffuser 10 acts like a piano-convex lens PXL.

One form of the diffusers 10 are commercially available and sold under the trade name of Varioptic™. Varioptic is a business unit of Parrot Corporation, located in Lyon, France, and which sells through distributors such as Westech Associates, Los Gatos, Calif., USA. The diffuser shown in U.S. Pat. Nos. 7,443,596; 7,499,223 and 7,515,350, of which Varioptic is an Assignee, are incorporated herein by reference and made a part hereof.

Figure 16A:
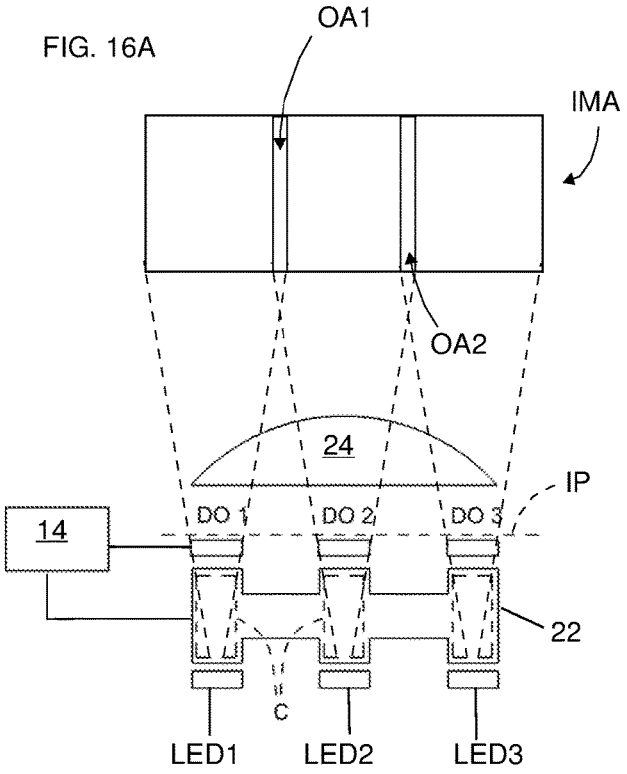
FIGS. 16A and 16B illustrate a light guide interposed between the LEDs and the diffusers.

Referring now to FIGS. 16A-24, various other embodiments will now be shown and described. For ease of illustration, three LEDs 12 (labeled LED1, LED2 and LED3) and their corresponding diffusers 10 (labeled DO1, DO2 and DO3) are shown. In FIG. 16A, the diffusers 10 or deformable optics are mounted at exit points of a light guide 22 having transmission channels C. A lens 24 may be used in combination as well. "Light guide" Is a term of art and refers to a waveguide which transmits light largely through total internal reflection. The diffusers 10 or deformable optics DO1-DO3 shown in FIG. 16A are represented as rectangles because they act as flat glass plates and do not diffuse light in that condition.

Figure 16B:
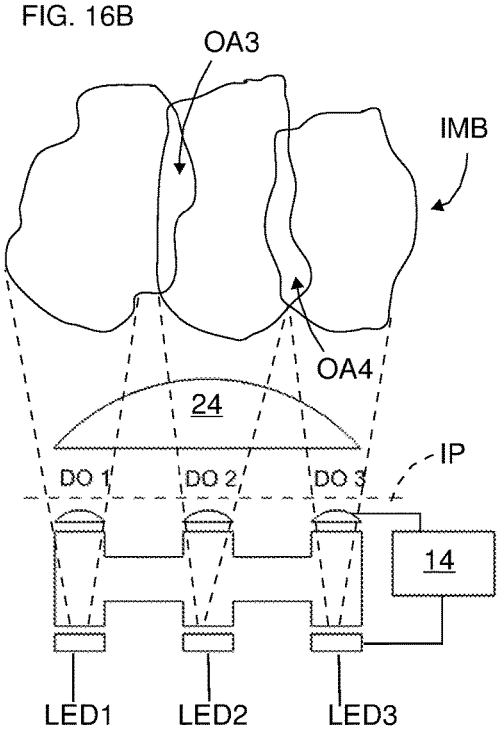

In FIG. 16B, the deformable optics DO1-DO3 are energized to provide piano-convex lenses that diffuse light from the plurality of LEDs 12 (LED1, LED2 and LED3). This arrangement improves uniformity of light intensity in the image IMB, especially the overlap areas OA3 and OA4. The configuration in FIG. 16B creates very soft boundaries and overlap in areas OA3 and OA4 when no tunnel D or trap is required. In contrast, note in FIG. 16A, that the diffusers 10 or deformable optics DO act as flat plates and provide a sharp cut-off for the tunnels. The controller or control 14 determines and adjusts the state and shape of the diffusers 10 or the deformable optics DO by applying a proper voltage in a manner conventionally known. Under one form of the invention and as described earlier, pixels flanking the tunnel D (FIG. 14B) alternate between two modes. In one mode, the plurality of diffusers 10 are not energized and the image pixels have a sharp cut-off when the tunnel D is present. In the second fuzzy mode the plurality of diffusers 10 are energized and have fuzzy or diffused edges and the tunnel D is absent.

Figure 17A:
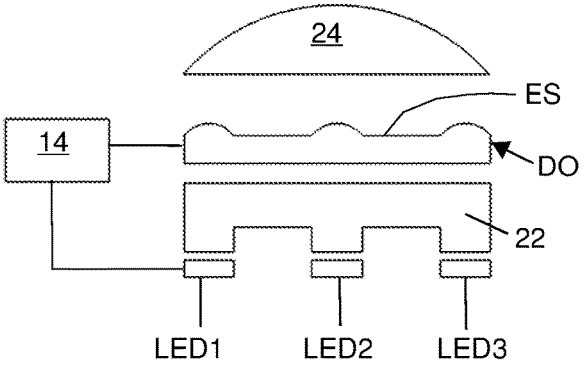
FIGS. 17A and 17B illustrate the diffusers integrated into a unitary structure.
Figure 17B:
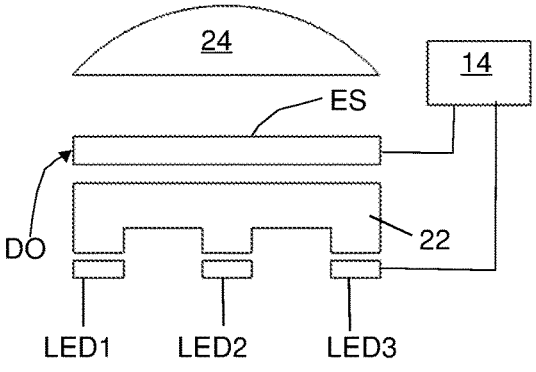

In FIGS. 17A-17B, the plurality of diffusers 10 or deformable optics DO are integrated into a single unit, the external surface ES alternates between that of FIG. 17A to that shown in FIG. 17B. The external surface ES corresponds in principle to the flexible element 20 in FIG. 15. The plurality of diffusers 10 or deformable optics DO in FIG. 17A can be deformed using a voltage, as described earlier relative to FIG. 15, or by using fluid pressure. The controller or control 14 in FIGS. 17A-17B controls the voltage or fluid pressure as appropriate to achieve the desired shape.

Figure 18:
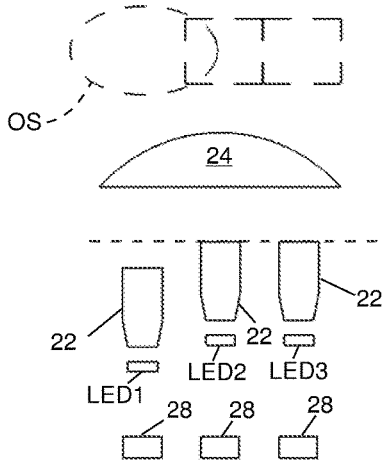
FIG. 18 illustrates how the LEDs and their associated light guides can move or be physically repositioned to generate the diffusion of light.

In FIG. 18, the relative position of the LED 12, such as LED LED1, LED2 or LED3, can be mechanically altered by a driver or other movement inducers 28 to alter the focus and/or diffusion of its transmitted light. Images IM at the top of FIG. 18 represent the differences in projected pixels resulting from the change in positions. The oval-shaped image OS illustrates the diffusion.

Figure 19A:
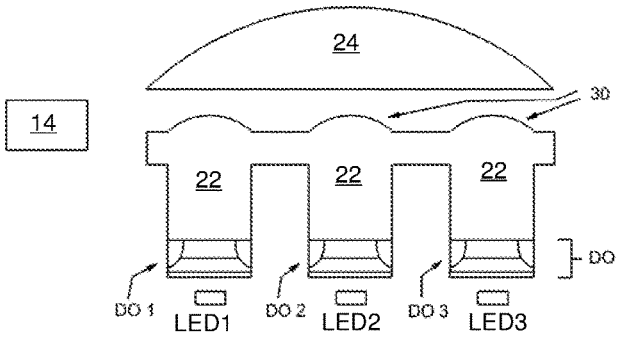
FIGS. 19A and 19B illustrate the deformable optic of FIG. 15 used in the diffusers and position adjacent the LEDs.
Figure 19B:
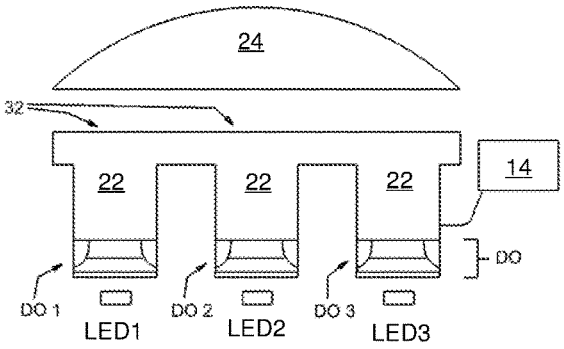

In the embodiment of FIGS. 19A and 19B, the plurality of diffusers 10 or deformable optics DO comprise the voltage-controlled deformable optics described relative to FIG. 15. The light guide 22 can have curved, focusing, exit faces 30, flat exit faces 32 or other optics.

Figure 20:
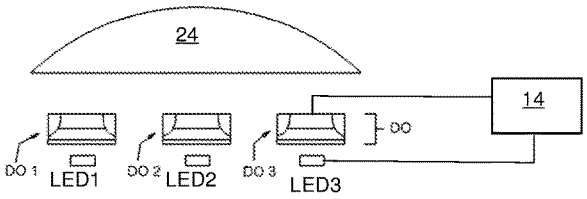
FIG. 20 illustrates one form of the invention in which no light guide is present between the deformable optics and an imaging lens.
Figure 21A:
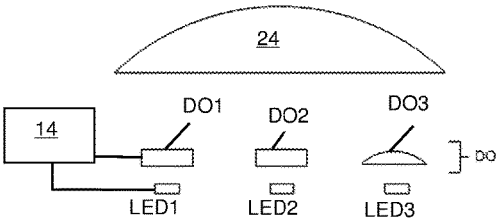
FIGS. 21A and 21B illustrate operation of the apparatus of FIG. 20.
Figure 21B:
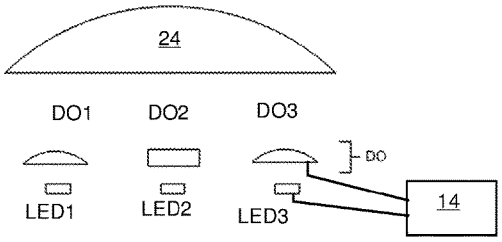
Figure 22:
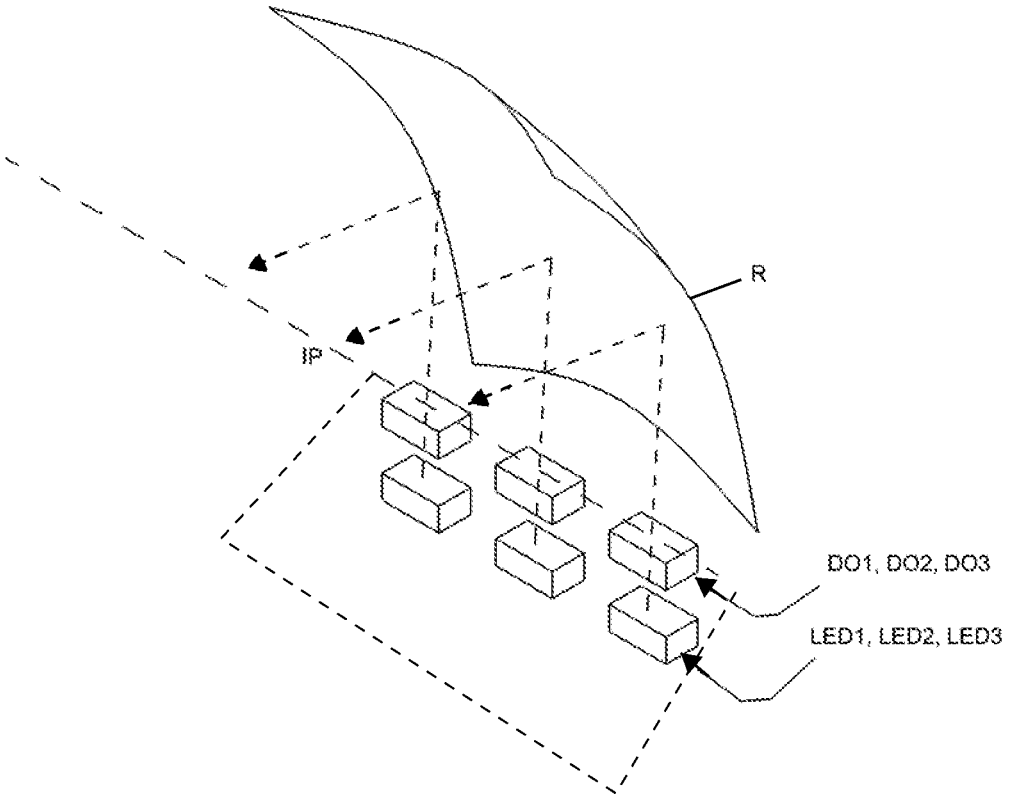
FIG. 22 illustrates another embodiment of the invention.

In the embodiment of FIG. 20, unlike FIGS. 19A and 19B, which show the light guide 22, there is no light guide 22 present between the deformable optics DO1-DO3 and the imaging lens 24. The apparatus operates as illustrated in FIGS. 21A and 21B. In FIG. 21A, selected deformable optics DO1 and DO2 are energized or driven into their flat, non-diffusing condition. In FIG. 21B, selected deformable optics DO1 and DO3 are energized or driven into a new shape or their diffusing condition. For ease of illustration, the deformable optics DO1-DO3 in FIGS. 21A and 21B are illustrated in their final energized state.

Figure 23:
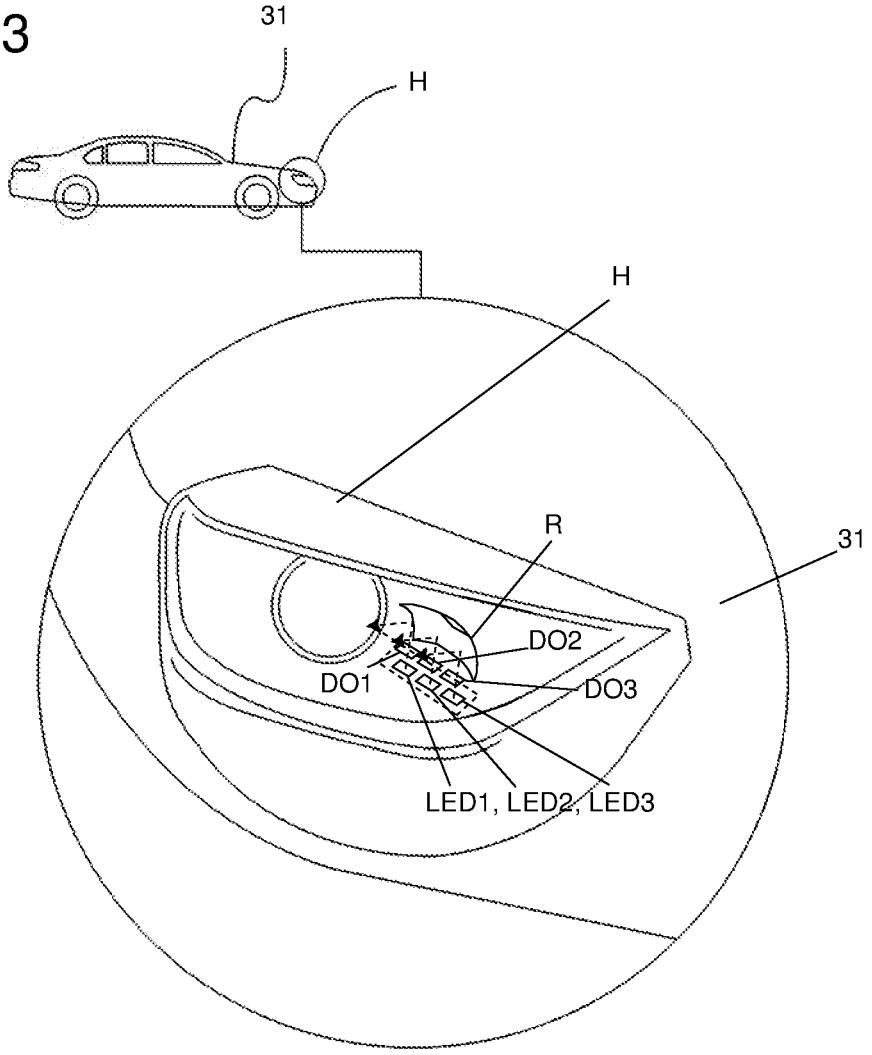
FIG. 23 illustrates another embodiment of the invention.

In FIG. 23, the deformable-optic/LED assembly, such as one of those described above, may be associated with at least one or a plurality of reflectors R, such as a parabolic reflector. In this case, an image plane IP (FIGS. 15A, 15B and 23) of the LEDs 12 is located at the focus of the reflector R, so that the reflector R transmits parallel and collimated beams.

Figure 24:
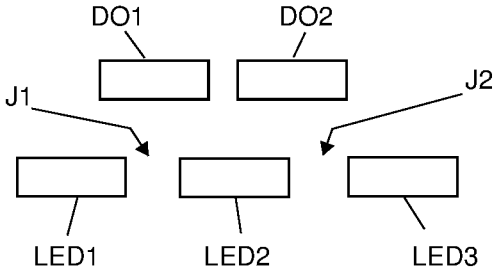
FIG. 24 illustrates another embodiment of the invention.

In FIG. 24, note that the LEDs LED1-LED3, DO1-DO3 and reflector R may be placed in a housing or bezel H of the vehicle 31 to produce or generate at least one of a headlamp beam, a rear lamp beam, a tail lamp beam, a signal beam or an interior lighting device or the like. It should be understood that the illustrations shown and described herein could have more or fewer light sources or LEDs 12 or deformable optics or diffusers 10 or lens 24.

Additional Considerations

FIG. 24 illustrates another embodiment of the invention in which the diffusers or deformable optics DO1 and DO2 are located at the junctions J1 and J2 between adjacent LEDs. That is, the diffuser 10 or deformable optic DO1 receives light from both LED1 and LED2. The diffuser 10 or deformable optic DO2 receives light from both LED2 and LED3 This approach locates the diffuser 10 or deformable optics DO at the locations where the overlap originates. That is, the overlap occurs because light from two LEDs coalesces at a common region. The positioning of the diffuser 10 or deformable optics DO1, DO2 as shown in FIG. 24 is seen as attacking the situation at its origin. Alternately, the deformable optics DO1 and DO2 can be located at intermediate positions between perfect alignment over LED1 and perfect alignment over LED2.

The diffusers 10 or deformable optics, such DO1, DO2, and DO3 in FIGS. 16A-16B, alternate between two focal lengths, such as infinity for a flat glass plate (FIG. 16A), and a finite length for a piano-convex lens (FIG. 16B).

The plurality of images IM1 to IMn that make up the image IMAR (FIG. 10) provide or define a light beam that can be termed a full-width beam. The beam may be at least one of a headlamp beam, a rear lamp beam, a tail lamp beam, a signal beam or an interior lighting device.

The pair of light beams labeled L1 and L2 in FIG. 13 can be termed a partial-width beam because the overall width of those two beams L1 and L2, measured from the extreme left edge ELE to the extreme right edge ERE in the FIG. 13 is the same as the full-width beam of FIG. 10, but the illuminated width only spans the distances labeled L1 and L2. The partial-width beam includes the tunnel D.

Alternately, the pair of light beams labeled L1 and L2 in FIG. 13 can be viewed as two partial-width beams L1 and L2 separated by the dark region or tunnel D. Of course, the dark region or tunnel D will not be absolutely dark because some scattered light may enter it.

The tunnel D need not be flanked or straddled by two light beams, but can occupy a single edge of the light beam. For example, in FIG. 13, the pixels on the right side, labeled IM21-IM 28, could all be dark. In this case, the "tunnel" would include tunnel D and the dark region previously illuminated by those eight pixels.

In one form of the invention, each diffuser 10 or deformable optic DO in FIG. 10 is individually controllable by the controller or control 14. In another form of the invention, the plurality of diffusers 10 or deformable optics DO may be controlled together. For example, if the system always alternates between the two states shown in FIGS. 14A and 14B, then the diffusers 10 in columns 2, 3, and 4 may be controlled together because they are either always all on together or always off together. There is no reason to turn on the diffuser D13 in column 4, for example, by itself, and the diffusers D1 and D17 in columns 1 and 5, respectively, may always be either on or off.

In one form of the invention, the plurality of LEDs 12 is examined during manufacture to ascertain which of the plurality of LEDs 12 produce light beams or images which overlap. A diffusing element 10 or deformable optic DO may then be provided for only those LEDs 12 which overlap, but not the other LEDs 12 because the latter require no diffusers 10. Thus, LEDs 12 which cause no overlap may not be supplied with diffusers 10, but LEDs 12 which do cause overlap may be supplied with diffusers 10. Alternately, diffusers 10 can be provided for all LEDs 12, but only the diffusers 10 for the LEDs 12 which cause overlap are ever actuated or energized.

This invention, including all embodiments shown and described herein, could be used alone or together and/or in combination with one or more of the features covered by one or more of the claims set forth herein, including but not limited to one or more of the features or steps mentioned in the Summary of the invention and the claims.

While the system, apparatus and method herein described constitute preferred embodiments of this invention, it is to be understood that the invention is not limited to this precise system, apparatus and method, and that changes may be made therein without departing from the scope of the invention which is defined in the appended claims.

The invention claimed is:

1. A lamp assembly system of a vehicle comprising:

a housing that is configured to incorporate together the system's constituent elements;

a cover lens;

a number of light sources that generate an array or matrix of pixel images, wherein said system addresses a problem of overlapping beam sections of the array or matrix pixel images in at least one overlap area;

a number of light diffusers which diffuse light that reaches the at least one overlap area to reduce a light intensity thereof, wherein said number of diffusers is operable in either an on or off state, where the at least one diffuser changes a direction of the light in an on state and the at least one diffuser is transparent in the off state;

a controller that is configured to manage output of said light sources and that is also configured to control each respective diffuser, where said controller is configured to energize each respective diffuser to reduce light intensity of a related overlap projection area, where said controller is configured to not energize an associated respective diffuser when a non-illuminate condition is met, wherein said non-illuminate condition is determined by a transition that occurs along a number of sharp edges between an illuminated area and a non-illuminated area of said array or matrix of associated pixel images;

wherein said controller is configured to deactivate said diffusers associated with at least one of said light sources when the associated said light source is in an "on" state and defines an edge of an unlit tunnel.

2. The system of claim 1, wherein each diffuser includes at least one diffusing element per respective light source.

3. The system of claim 1, wherein the cover lens includes at least one of the following types: a plano-concave lens (PCL), a flat lens (FL), a plano-convex lens (PXL), an imaging lens a liquid lens, a composite lens or some combination thereof.

4. The system of claim 1, wherein said system addresses the problem of overlapping beam sections caused from a number of pixels and corrects overlapping beam sections.

5. The system of claim 1, wherein the problem is addressed or corrected through deactivation of groups of pixels associated with the number of light sources.

6. The system of claim 1, further including a deformable optic.

7. The system of claim 6, wherein said diffusers include a deformable optic that alters a focal length in response to an electrical signal.

8. The system of claim 1, wherein said diffusers comprise an array of diffusing elements where each diffusing element in said array of diffusing elements comprise a lens which changes in curvature in response to electrical signals.

9. The system of claim 1, wherein the light source is at least a type from the following: a light-emitting diode LED, a highly pixelized LED or a laser diode.

10. The system of claim 1, further comprising an imaging lens which projects images of light produced by said plurality of light sources and wherein said at least one diffuser is located between said plurality of light sources and said imaging lens.

11. The system of claim 1, wherein each of said diffusers comprises a liquid lens comprising two liquids of different indices of refraction, which change shape in response to an electrical signal.

12. The system of claim 1, said system further comprising at least one light guide associated with each light source, where each said light guide extends from an associated respective light source towards an associated respective diffuser.

13. The system of claim 1, wherein said system includes a housing and a cover lens that cooperate to house both said number of light sources and said number of diffusers.

14. A light system of a motor vehicle system wherein said system further comprises:

a plurality of light sources, a plurality of diffusers and a controller that is configured to manage said light sources and said diffusers;

wherein said controller activates a portion of said light sources and deactivates a portion of said diffusers so as to generate a plurality of sharp edges and an unlit tunnel in said image array or matrix of pixel images;

said controller being further adapted to energize a first group of said light sources, the controller further adapted to deactivate a portion of said diffusers of an array or matrix of pixel images that cause a number of generally sharp transition edges between a number of overlap areas that are illuminated and non-illuminated; wherein said controller is further adapted to energize the first group of said light sources while activating a portion of said diffusers that cause the array or matrix of pixel images that include a smooth light intensity in a number of remaining portions of said overlap areas.

* * * * *